US010967642B2

(12) United States Patent
O'Reilly et al.

(10) Patent No.: US 10,967,642 B2
(45) Date of Patent: Apr. 6, 2021

(54) CONTAINERS WITH LID MANIFOLDS

(71) Applicant: Hewlett-Packard Development Company, L.P., Houston, TX (US)

(72) Inventors: Aidan O'Reilly, Leixlip (IE); Charles Keegan, Leixlip (IE); Brian Cronly, Leixlip (IE); Ivor Cummins, Leixlip (IE); Patrick V. Boyd, Corvallis, OR (US); William Black, Leixlip (IE); Bryan Murphy, Leixlip (IE); Lynn Walsh, Leixlip (IE)

(73) Assignee: Hewlett-Packard Development Company, L.P., Spring, TX (US)

( * ) Notice: Subject to any disclaimer, the term of this patent is extended or adjusted under 35 U.S.C. 154(b) by 254 days.

(21) Appl. No.: 16/304,818

(22) PCT Filed: Jun. 3, 2016

(86) PCT No.: PCT/US2016/035744
§ 371 (c)(1),
(2) Date: Nov. 27, 2018

(87) PCT Pub. No.: WO2017/209763
PCT Pub. Date: Dec. 7, 2017

(65) Prior Publication Data

US 2020/0316950 A1 Oct. 8, 2020

(51) Int. Cl.
*B41J 2/175* (2006.01)

(52) U.S. Cl.
CPC ..... *B41J 2/17513* (2013.01)

(58) Field of Classification Search
CPC ..... B41J 2/175; B41J 2/17523; B41J 2/17513
See application file for complete search history.

(56) References Cited

U.S. PATENT DOCUMENTS 4,162,501 A 7/1979 Mitchell et al.
5,751,322 A 5/1998 Miller et al.
(Continued)

FOREIGN PATENT DOCUMENTS

CN 1198986 11/1998
CN 1255433 6/2000
(Continued)

OTHER PUBLICATIONS

Hewlett-Packard Journal, "History of ThinkJet Printhead Development," May 1985, Available at: http://citeseerx.ist.psu.edu/viewdoc/download?doi=10.1.1.186.3672&rep=rep1&type=pdf, 40 pages.

*Primary Examiner* — Huan H Tran
(74) *Attorney, Agent, or Firm* — Fabian VanCott

(57) ABSTRACT

One example provides an article. The article includes a container body. The article includes a lid covering the container body, the lid including a lid aperture to permit passage of a printing fluid into the container body. The article includes a lid manifold mounted to the lid. The lid manifold includes a lid manifold input port to be fluidly connected to and disconnected from a container manifold port of a separate printing system. The lid manifold includes a lid manifold output opening that is in the form of a needle having a length of less than or equal to about 6 mm and is fluidly connected to the lid aperture. The lid manifold includes a channel fluidly connecting the lid manifold input port and the lid manifold output opening.

16 Claims, 10 Drawing Sheets

(56) References Cited

U.S. PATENT DOCUMENTS

| | | | | |
|---|---|---|---|---|
| 6,474,802 | B1 | 11/2002 | Lui | |
| 6,802,601 | B2 | 10/2004 | Suzuki et al. | |
| 7,004,574 | B2 | 2/2006 | Neese et al. | |
| 10,457,055 | B2 * | 10/2019 | O'Reilly | B41J 2/175 |
| 2003/0214565 | A1 | 11/2003 | Lee et al. | |
| 2004/0165044 | A1 | 8/2004 | Yamada | |
| 2005/0110848 | A1 | 5/2005 | Tsuchiya et al. | |
| 2014/0184709 | A1 | 7/2014 | Qian et al. | |
| 2018/0215158 | A1 * | 8/2018 | O'Reilly | B41J 2/1752 |

FOREIGN PATENT DOCUMENTS

| | | | | |
|---|---|---|---|---|
| CN | 203004530 | | 6/2013 | |
| JP | 2014189010 | | 10/2014 | |
| JP | 2015178280 | | 10/2015 | |
| JP | 2016087849 | | 5/2016 | |
| WO | WO 2017/036490 | * | 3/2017 | B41J 2/175 |

* cited by examiner a b a b a b c d a b

CONTAINERS WITH LID MANIFOLDS

BACKGROUND

Cartridges may be used in connection with printing systems. Some printing systems may not be equipped with a mechanical pumping arrangement for transport of printing fluid to the cartridges.

BRIEF DESCRIPTION OF THE DRAWINGS

The drawings are provided to illustrate various examples of the subject matter described herein in this disclosure (hereinafter "herein" for short, unless explicitly stated otherwise) related to containers with lid manifolds and are not intended to limit the scope of the subject matter. The drawings are not necessarily to scale.

FIGS. 3*a*, 3*b* and 3*c* are schematics showing an example cartridge lid, wherein FIG. 3*a* illustrates the example cartridge lid without additional parts, FIG. 3*b* additionally illustrates example sealing septa, and FIG. 3*c* illustrates the example cartridge lid with an example lid manifold mounted to it.

FIGS. 4*a* and 4*b* are schematics showing cross-sectional views through the example replaceable containers of FIG. 2*b*, wherein FIG. 4*b* shows a magnified section of FIG. 4*a*.

FIGS. 5*a* and 5*b* illustrate an example lid manifold of the replaceable cartridge in a) perspective (top)-view and b) perspective (bottom)-view. FIG. 5*c* shows a perspective view of the replaceable cartridge body with an example lid mounted to it. FIG. 5*d* illustrates the replaceable cartridge with the example lid of FIG. 5*c* and the example lid manifold of FIGS. 5*a*, 5*b* mounted to it.

FIG. 7*a* is a side view of a first example removable plug; FIG. 7*b* is a perspective view of the first example removable plug inserted into the example replaceable cartridge of FIG. 2*a*; FIG. 7*c* is a cross-sectional view through FIG. 7*b*; and FIG. 7*d* is a perspective view of a second example removable plug to be inserted into the example cartridge of FIG. 2*b*.

DETAILED DESCRIPTION

Figure 1:
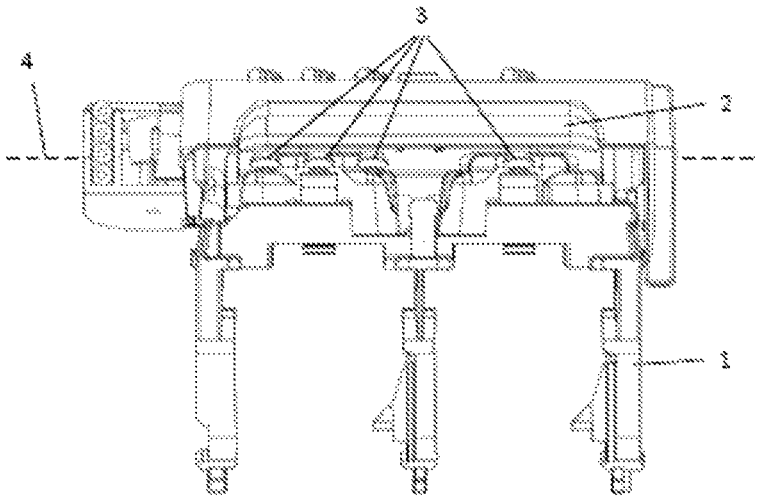
FIGS. 1*a* and 1*b* are schematics showing an example holding fixture and an example carriage manifold of a printing system in a) front view and b) side view.
Figure 1:
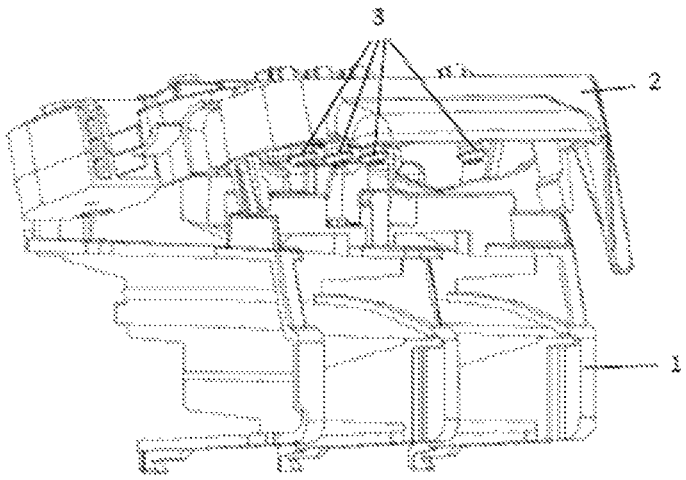

Printing systems without a mechanical pumping arrangement for transport of printing fluid may be employed, particularly with replaceable printing fluid containing container. A printing system may include, for example, a printer. In one example, such a container may be referred to as a cartridge. A replaceable cartridge may be removed from and installed in the printing system by users of the printing system.

In many instances, it is desirable to maintain an air path between the foam and the manifold opening in a cartridge. Such a path may allow the air within the cartridge to expand back up the tubes during temperature cycling when the temperature has increased. However, the designs of many current cartridges do not allow sufficient air path, thus negatively impacting the performance of the cartridge, and in turn the printing system.

In view of the aforementioned challenges related to air path, the Inventors have recognized and appreciated the advantages of a container with a lid manifold. Following below are more detailed descriptions of various examples related to a container with lid manifold. The various examples described herein may be implemented in any of numerous ways.

Provided in one aspect of the examples is an article, comprising: a container body; a lid covering the container body, wherein the lid comprises a lid aperture to permit passage of a printing fluid into the container body; and a lid manifold mounted to the lid, wherein the lid manifold comprises: a lid manifold input port to be fluidly connected to and disconnected from a container manifold port of a separate printer system, a lid manifold output opening that is in the form of a needle having a length of less than or equal to about 6 mm and is fluidly connected to the lid aperture, and a channel fluidly connecting the lid manifold input port and the lid manifold output opening.

Provided in another aspect of the examples is an article, comprising: a container body; a lid covering the container body, wherein the lid comprises a lid aperture to permit passage of a printing fluid into the container body, the lid aperture comprising a sealing septum having a crenulated exterior; and a lid manifold mounted to the lid, wherein the lid manifold comprises: a lid manifold input port to be fluidly connected to and disconnected from a container manifold port of a separate printer system, a lid manifold output opening fluidly connected to the lid aperture, and a channel fluidly connecting the lid manifold input port and the lid manifold output opening.

Provided in another aspect of the examples is a covering device replaceably covering a container body, comprising: a handling element; a lid aperture to permit passage of a printing fluid into the container body, the lid aperture comprising a sealing septum having a crenulated exterior; and a cover to cover a lid manifold input port of the container body, the lid manifold comprising: a lid manifold input port to be fluidly connected to and disconnected from a container manifold port of a separate printer system, a lid manifold output opening that is in the form of a needle having a length of less than or equal to about 6 mm and is fluidly connected to the lid aperture, and a channel fluidly connecting the lid manifold input port and the lid manifold output opening; and a lid covering the container body, wherein the lid comprises a lid aperture to permit passage of a printing fluid into the container body, the lid aperture comprising a sealing septum having a crenulated exterior.

To the extent applicable, the terms "first," "second," "third," etc. herein are merely employed to show the respective objects described by these terms as separate entities and are not meant to connote a sense of chronological order, unless stated explicitly otherwise herein.

FIGS. 1*a*, and 1*b* are schematic illustrations of an example holding fixture 1 and an example carriage manifold 2 of such a printing system. FIG. 1*a* is a front view and FIG. 1*b* is a side view illustration of the components of the printing system.

The holding fixture 1 is for the replaceable installation of the articles described herein (but not shown in FIGS. 1*a* and 1*b*) in the printing system. In at least one example, the articles may be a cartridge, such as a replaceable cartridge, for a printer. Only for the sake of discussion, the term "cartridge" is employed in many instances herein to describe representatively the term "article" herein, but it is noted that the articles described herein need not be limited to only cartridges.

The replaceable cartridges may be installed in the holding fixture 1 by inserting the replaceable cartridges into the holding fixture 1. The holding fixture 1 may have a fastening system for fastening the inserted replaceable cartridges at an envisaged position. The holding fixture 1 of FIGS. 1*a* and 1*b* is for the installation of two replaceable cartridges. In other examples, the holding fixtures are for a single, three, four, or another number of replaceable cartridges.

The installed replaceable cartridges may be removed from the holding fixture again. In some examples, removing the replaceable cartridges from the holding fixture may involve undoing a fastening mechanism of the fastening system of the holding fixture. As the replaceable cartridges may be removed from the holding fixture, the holding fixture may be referred to as a holding fixture to replaceably install replaceable cartridges.

The carriage manifold 2 has carriage manifold ports 3 to establish disconnectable fluid connections to the replaceable cartridges, and, when connected, to supply printing fluid to the replaceable cartridges. The carriage manifold ports 3 may be fluidly connected to ink tanks located remotely from the replaceable cartridges. The connection to the ink tanks may be established using the respective end sections of the carriage manifold ports 3, which are not envisaged to be in direct physical contact with the replaceable cartridges. The carriage manifold 2 of FIGS. 1*a* and 1*b* may have four carriage manifold ports 3, which may have a shape of needles. The needles may be flexible needles. In other examples, carriage manifolds may have another number of carriage manifold ports 3, such as one, two, three, five and six carriage manifold ports 3. In other examples, the carriage manifold ports 3 have forms different from the needle form of FIGS. 1*a* and 1*b*. It is noted that in some instances a lubricant may be used to facilitate engagement between the needle and the port(s) of the articles.

The carriage manifold 2 may be mounted to the holding fixture 1 to pivot around a pivot axis 4. For mounting to the holding fixture 1 the carriage manifold 2 is supported by a supporting structure. The supporting structure may either be part of the carriage manifold 2 or an independent part. The carriage manifold 2 has the ability to pivot around the pivot axis 4 from a first pivot position to a second pivot position. The pivoting movement is used to control the fluid connection between the carriage manifold 2 and the replaceable cartridges installed in the printing system. In the first pivot position, the carriage manifold 2 may be fluidly disconnected from the replaceable cartridges. In the second pivot position, the carriage manifold 2 may be in fluid connection with the replaceable cartridges to supply printing fluid to the replaceable cartridges. In FIGS. 1*a* and 1*b*, the carriage manifold 2 is in the first pivot position and no replaceable cartridges are installed in the printing system. The transition between the first and second pivot positions of the carriage manifold 2 are described in more detail later with reference to FIGS. 4 and 5.

FIGS. 2*a* and 2*b* are schematic illustrations of example replaceable cartridges 5, 6 to be installed in the holding fixture 1. The replaceable cartridges 5, 6 each comprises a cartridge body 7, 8, a cartridge lid 9, 10, and a lid manifold 13, 14.

The container bodies 7, 8 are at least substantially prismatic and may comprise rectangular, opposing faces. In this context, substantially prismatic may refer to that the basic shape of the container bodies 7, 8 is prismatic, while details of the container bodies 7, 8 may deviate from the prismatic shape. In one example, the borides are prismatic. In one example, the shape of the container body is entirely (completely) prismatic. The internal space of the container bodies 7, 8 is partly hollow and may comprise an area for storage of printing fluid. In one example, the area for storage of printing fluid includes a foam structure capable of absorbing printing fluid to be stored.

The (cartridge) lids 9, 10 are formed as, and/or have a shape of, at least substantially two dimensional, planar sheets. In this context, substantially two-dimensional means that the thickness of the lids 9, 10 is small compared to their lengths and/or widths. In one example, the lids are (completely) two dimensional, planar sheets. Each of the sheets covers one face of the corresponding container body 7, 8. In some examples, the lids 9, 10 themselves define the face of the corresponding container bodies 7, 8, while in other examples the lid 9, 10 is mounted to the face of the corresponding container bodies 7, 8.

The lid manifold 13 of the replaceable cartridge 5 of FIG. 2*a* is mounted to the lid 9. In some examples, the mounting of the lid manifold 13 to the lid 9 is achieved by snap-fitting the lid manifold 13 to the lid 9. The lid manifold 13 comprises one lid manifold input port 15. This one lid manifold input port 15 is formed as, and/or has a shape of, a tube socket. The tube socket 15 protrudes away from the lid manifold 13 in a direction which is at least substantially perpendicular to the outer surface of the at least substantially two-dimensional planar lid 9. In this context, substantially perpendicular refers to that the tube socket 15 and the outer surface of the lid 9 include an angle between about 85° and about 95°. In some examples, the included angle is completely perpendicular—i.e., 90°. The tube socket 15 may be of such a shape that it is able to engage with one port 3 of the carriage manifold 2, which in the example of FIGS. 1*a* and 1*b* are in the shape of needles. When one needle 3 and the tube socket 15 are engaged, a fluid connection between the carriage manifold 2 and the replaceable cartridge 5 may be established.

In one example, the lid manifold 13 may comprise a flat body, which has a minimal thickness sufficient to form a channel within the bulk of the flat body. The upper limit of the flat body's thickness is defined by the thickness of the channel plus the wall thickness around the channel. In other words, the flat body may be as thin as possible under the consideration that it may accommodate the channel (the channels of the lid manifolds 13, 14 will be described in detail later with reference to FIG. 4). In one example, the tube socket 15 is also perpendicular to the outer surface of the flat body. In another example, the flat body thickness may be independent of the channel thickness. Laterally, the flat body of the lid manifold 13 may extend over and cover a large portion of the cartridge lid 9.

In some examples, one type of printing fluid is supplied to the replaceable cartridge 5 using the one lid manifold input port 15, which is to be disconnectably connected to one carriage manifold port 3 of the printing system. The replaceable cartridge 5 may then be referred to as "single printing fluid cartridge".

The lid manifold 14 of the replaceable cartridge 6 of FIG. 2*b* may comprise three lid manifold input ports 16, which are in the shape of separate tube sockets positioned along a straight line. In one example, the lid manifold 14 comprises a flat body, which accommodates three channels. In one example, the three channels inside the lid manifold 14 run next to each other along a plane which is substantially in parallel to the cartridge lid's 10 outer surface. In one example, the channels do not cross each other. In this context, substantially parallel means that the channels and the cartridge lid's outer surface include an angle of less than 5°. In some examples, the extension direction of the channels is entirely parallel with respect to the outer surface of the cartridge lid 10. Besides having three tube sockets 16 and three channels, the lid manifold 14 of FIG. 2*b* is constructed similarly to the lid manifold 13 of FIG. 2*a*. Details described with respect to lid manifold 13 are also present in lid manifold 14, and vice versa.

In some examples, three separate fluid connections between the carriage manifold 2 of the printing system and the replaceable cartridge 6 may be disconnectably established. In one example each fluid connection is defined by a particular carriage manifold port 3 and a particular lid manifold input port 16. In some examples, one particular type of printing fluid is supplied to the replaceable cartridge 6 using each separate fluid connection. Three different types of printing fluid may then be supplied to the replaceable cartridge in total. In this case, the replaceable cartridge 6 may be referred to as "three printing fluid cartridge."

FIGS. 2*a* and 2*b* illustrate replaceable cartridges 5, 6 with lid manifolds 13, 14 having one and three lid manifold input ports 15, 16, respectively. In other examples, replaceable cartridges have two, four, five, six, or a different number of lid manifold input ports. Replaceable cartridges having more than one lid manifold input port with corresponding separate fluid connection may generally be referred to as "multi printing fluid cartridges."

Also, FIGS. 2*a* and 2*b* illustrate lid manifold input ports 15, 16 as being in the shape of tube sockets. In other examples, the lid manifold input ports may have a different form. Generally, the form of the lid manifold input ports may fit together with the form of the corresponding carriage manifold ports, so that the removable engagement of lid manifold input ports and carriage manifold ports may provide liquid and air tight fluid connections between the carriage manifold and the replaceable cartridge.

In some examples, the lid manifold input ports being in the shape of tube sockets (such as input ports 15, 16 shown in FIGS. 2*a* and 2*b*) are provided with a notch. The notch may be formed at the mouth of the tube socket and extend from the mouth, which is remote from the cartridge lid, towards the carriage lid/the lid manifold's body along the tube socket. The length of the notch may be small enough that there may still be an air tight connection between the tube socket and the carriage manifold port, which has a shape of a needle, with the latter one inserted into the first one. The technical function of the notch may become apparent when covering the lid manifold input ports with a removable tape, as explained in detail later with reference to FIG. 8. Lid manifold input ports having a form different to tube sockets may also be provided with a notch similar to the one described above.

FIGS. 3*a*, 3*b*, and 3*c* provide more detailed illustrations of an example cartridge lid 10 of the replaceable cartridge 6. FIG. 3*a* displays the cartridge lid 10 without any additional parts. The cartridge lid 10 comprises three lid apertures 11. Through the lid apertures 11 printing fluid may be supplied into the container body 8. To supply printing fluid to the container body 8 injection needles may be inserted through the lid apertures 11 into the internal space of the container body 8. When areas for storing of printing fluid are included in the container body 8, the printing fluid may be supplied to the areas. In case three separate areas for storing of printing fluid are included in the container body 10, those areas may be centrally arranged below the three lid apertures 11. In this way printing fluid may easily be injected into each of the three separate areas through the corresponding lid apertures 11.

In the example of FIG. 3*b*, the lid apertures 11 of cartridge lid 10 additionally comprise sealing septa 12. An injection needle may penetrate each of the sealing septa 12 to access the internal space of the container body 8. Each sealing septum 12 creates a liquid and air tight sealing between the corresponding lid aperture 11 and the needle injected through the sealing septum 12. A septum may have any suitable geometry. In one example, the septum described herein may have a crenulated exterior.

FIG. 3*c* shows the cartridge lid 10 of FIGS. 3*a* and 3*b* with an example lid manifold 14 mounted to it. The lid manifold 14 has three lid manifold input ports 16, which are in the shape of tube sockets. The lid manifold 14 is aligned on the cartridge lid 10 based on the mounting assistance protrusions 10*a* of the cartridge lid 10.

Even though FIGS. 3*a*, 3*b*, and 3*c* illustrate a cartridge lid 10 having three lid apertures 11 with corresponding three sealing septa 12, in other examples cartridge lids may have one, two, four, five, six, or a different number of lid apertures with sealing septa. In some examples, the lid apertures are not provided with sealing septa at all.

For some example replaceable cartridges, the number of lid apertures and sealing septa may correspond to the number of lid manifold input ports, as well as to the number of storage areas for printing fluids in the container body. In these examples, separate fluid connections from a particular carriage manifold port to a particular storage area may be established using a particular lid manifold input port and a particular lid aperture with sealing septum. To establish such separate fluid connections, a particular lid manifold input port may be fluidly connected to a particular lid aperture with sealing septum. An example of such separate fluid connections is discussed below with reference to FIGS. 4*a* and 4*b*.

FIGS. 4*a* and 4*b* illustrate cross-sectional views through the example removable cartridge 6 of FIG. 2*b*. The cross-section runs parallel to the x-axis indicated in FIG. 2*b* through the center of one of the lid manifold input ports 16, which are in the shape of tube sockets. FIG. 4*a* shows the removable cartridge 6 installed in the holding fixture 1 of the printing system and in fluid connection with the carriage manifold 2, i.e., the carriage manifold 2 is in the second pivot position, so that three needles 3 of the carriage manifold 2 are inserted in/engaged with the three tube sockets 16 of the lid manifold 14. FIG. 4*b* shows a magnified section of FIG. 4*a*. It is to be understood that—due to the nature of cross-section illustrations—just one separate fluid connection from the carriage manifold 2 to the replaceable cartridge 6 appears in FIGS. 4*a* and 4*b*. However, the structure of this below described fluid connection may be identical for the other two separate fluid connections not shown in FIGS. 4*a* and 4*b*.

As shown in FIG. 4*a*, the needle 3 of the carriage manifold 2 is engaged with the tube socket 16, which extends vertically away from the lid manifold's 14 body. This engagement is achieved by pivoting the carriage manifold 2 from its first pivot position to its second pivot position. During the pivoting movement the needle 3 is inserted into the tube socket 16. Since the needle 3 is located at a position distant to the pivot axis, at a pivoting radius considerable larger than the length of the needle, the insertion movement of the needle 3 at its way into the tube socket 16 runs along a substantially rectilinear engagement path. In this context, an engagement path is considered to be substantially rectilinear when the angle included between the needle 3 and the tube socket 16 is less than 5° during the engagement, i.e., when the needle 3 and the tube socket 16 are in direct, physical contact. In other examples, the included angle is less than 1°. The substantially rectilinear engagement patch contributes to a liquid and air tight fluid connection between the needle 3 and the tube socket 16.

The tube socket 16 itself is connected to a channel 17. The channel 17 extends inside the lid manifold's 14 body along an extension direction, which is substantially parallel to the outer surface of the cartridge lid 10. In this context, substantially parallel means that the channel 17 and the outer surface of the cartridge lid 10 include an angle of less than 5°. In some examples, the extension direction of the channel 17 is entirely parallel with respect to the outer surface of the cartridge lid 10. In some examples, the extension direction is also parallel with the outer surface of the lid manifold's 14 body. In some examples, where the lid manifold body is molded in one piece, the channel 17 inside the lid manifold body is formed by lateral drilling a stud hole into the lid manifold body in a direction parallel to the outer surface of the lid manifold 10, with the drilled stud hole subsequently sealed by an appropriate seal body.

At the end section not connected with the tube socket 16, the channel 17 is connected to the lid manifold output opening 18, which is formed as, and/or has a shape of, a lid manifold output needle. The lid manifold output needle 18 extends perpendicularly away from the channel 17 towards the cartridge lid 10. Directly underneath the end section of the channel 17 the lid aperture 11 with sealing septum 12 of the lid manifold 10 is located. The lid manifold output needle 18 thus may extend directly towards the sealing septum 12. A lower section of the lid manifold output needle 18 may penetrate/engage with the sealing septum 12 and provide a liquid and air tight fluid connection between the lid manifold output needle 18 and the sealing septum 12.

The needle 18 may have any suitable length. For example, the length may be less than or equal to about 7 mmm—e.g., less than or equal to about 6.5 mm, about 6 mm, about 5.5 mm, about 5 mm, about 4.5 mm, about 4 mm, or smaller. Larger or smaller values are also possible. In one example, the length is between about 3.0 mm about 5 mm—e.g., between about 3.5 mm and about 4.5 mm, between about 3.8 mm and 4.0 mm, etc. Other values are also possible. In one example, the length is about 3.9 mm. In one example, the needle 3 may have the same length as does the needle 18.

Through the lid aperture 11 with sealing septum 12, the internal space of the container body 8 may be accessed. Centered directly below the lid aperture 11 with sealing septum 12, an area 19 for storing of printing fluid (such as a foam structure) is located inside the container body 8. Thus, a fluid connection from the lid manifold output needle 18 to the area 19 for storing printing fluid is provided through the sealing septum 12.

In one example, as a result an individual fluid connection between the carriage manifold 2 and replaceable cartridge 6 is established. This individual fluid connection runs from the needle 3 using the tube socket 16, the channel 17, the lid manifold output needle 18, and the sealing septum 12 of the lid aperture 11 to the area 19 for storing printing fluid, which is located inside the body 8 of the replaceable cartridge 6.

As may be understood based on FIGS. 4*a* and 4*b*, a general technical task of the lid manifold 14 is to enable the above-described fluid connection by replaceably (or removably) connecting the needle 3 of the carriage manifold 2 with the sealing septum 12 of the lid aperture 11. Thus, the lid manifold 14 may be looked upon as a kind of adapter between those two components bypassing the spatial offset between the needle 3 and the sealing septum 12 with a fluid connection. The lid manifold 14 may act as the kind of adapter, as its lid manifold input port 16 and its lid manifold output opening 18 substantially have the same spatial offset with respect to each other as the needle 3 and the sealing septum 12, when the carriage manifold 2 is in the second pivot position. In this context, the spatial offset is considered to be substantially the same when the directed spatial difference between the two mentioned spatial offsets is less than 5% of the absolute spatial offset. In some examples, the spatial difference between the two mentioned spatial offsets may be less than 1%. In yet another example, the spatial offsets may be entirely the same.

In some examples, the lid manifold input port 16 has a spatial offset with respect to the lid manifold output opening 18, which has a component in a direction which is parallel to the outer surface of the cartridge lid 10.

FIGS. 5*a*, 5*b*, 5*c*, and 5*d* illustrate another example replaceable cartridge 35 that may be used in connection with the printing system of FIGS. 2*a* and 2*b*. FIGS. 5*a* and 5*b* show the lid manifold 29 of the replaceable cartridge 35 in detail. In one example, the lid manifold 29 comprises three lid manifold input ports 30, which are in the form of tube sockets. The tube sockets 30 of the replaceable cartridge 35 are similar to the tube sockets 16 of the replaceable cartridge 6 shown in FIG. 2*b*. Details described with respect to the tube sockets 16 apply to the tube sockets 30 as well.

In one example, the lid manifold 29 comprises three channels 31*a* fluidly connected to the tube sockets 30. The channels have the same function as the channels 17 of replaceable cartridge 6 described with reference to FIGS. 4*a*, 4*b*. However, while the channels 17 are completely embedded inside the bulk body of lid manifold 14, and thus form closed channels, the channels 31*a* of replaceable cartridge 35 are only sunk-in in the bottom outer surface of the body of the lid manifold 29, which is facing the cartridge lid 32 when the lid manifold 29 is mounted to the replaceable cartridge 35, and thus form open channels. In this context, the term "sunk-in" refers to channels which are not completely embedded inside the bulk body of a lid manifold 14. The open channels are closed by the upper outer surface of the cartridge lid 10, as may be seen in FIG. 5*d*. The channels 31*a* laterally extend in a direction which is parallel to the outer surface of the body of the lid manifold 29. The lateral extension direction corresponds to the flow direction of liquids through the channel 31*a*.

The cartridge lid 32 mounted to the body 34 of the replaceable cartridge 35 is shown in FIG. 5*c*. In one example, the cartridge lid 32 is made of, or comprises, a plastic material. The cartridge lid comprises three lid apertures 33. The lid apertures 33 are similar to the lid apertures 11 of FIG. 3*a*. Details described with respect to the lid apertures 11 apply to the lid apertures 33 as well. One difference between the cartridge lid 10 of FIGS. 3*a*, 3*b*, 3*c* and the cartridge lid 32 of FIGS. 5*c*, 5*d* is that the lid apertures 33 of cartridge lid 32 do not comprise sealing septa. A liquid and air tight fluid connection to the body 34 of the replaceable cartridge is not established using sealing septa. Instead, the lid manifold 29 is mounted to the cartridge lid 32 by laser welding. In one example, due to laser welding, the plastic of the cartridge lid 32 may melt, thereby connecting the cartridge lid 32 and the lid manifold 29 along the welding path 33.

The welding path 33 is predefined on the cartridge lid 32 prior to the welding. The welding path 33 corresponds in its shape to the shape of the three channels 31*a* of the lid manifold 29. By arranging the lid manifold 29 on the cartridge lid 32 and connecting the lid manifold 29 and the cartridge lid by laser welding along the welding path 33, the half-open channels 31*a* of the lid manifold 29 are closed and liquid and air tight fluid connections along the channels 31*a* are defined by the channels 31*a* and the outer surface of the cartridge lid 32.

As each of the three fluid connections defined by the channels 31*a* and the outer surface of the cartridge lid 32 encloses the corresponding lid aperture 33 in a liquid and air tight manner, no sealing septa are involved to establish a liquid and air tight fluid connection to the body 34 of the replaceable cartridge 35.

In some examples, the lid manifold 29 is made of, or comprises, a transparent plastic material. In some examples, the transparent plastic material may comprise a polyethylene terephthalate ("PET"). An example material may be clear PET. In some examples, laser welding is performed through the transparent lid manifold 29 in order to melt the plastic of the cartridge lid 32 along the welding path 33 and to join the cartridge lid 32 to the lid manifold 29.

FIG. 5*d* shows an example replaceable cartridge 35 with a cartridge lid 32. The figure shows that a lid manifold 29 is mounted to the replaceable cartridge 35 by welding the lid manifold 29 to the cartridge lid 32 along the welding path 33. Welding herein may refer to, for example, laser welding and ultrasonic welding, but other suitable welding techniques are also possible. The replaceable cartridge 35 may be installed in the holding fixture 1 of the printing system of FIGS. 1*a* and 1*b*.

Figure 2:
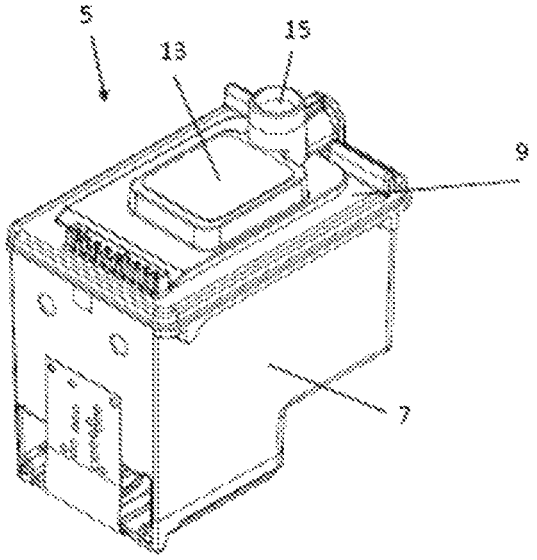
FIGS. 2*a* and 2*b* are schematics showing example replaceable containers with a) one and b) three lid manifold input ports.
Figure 2:
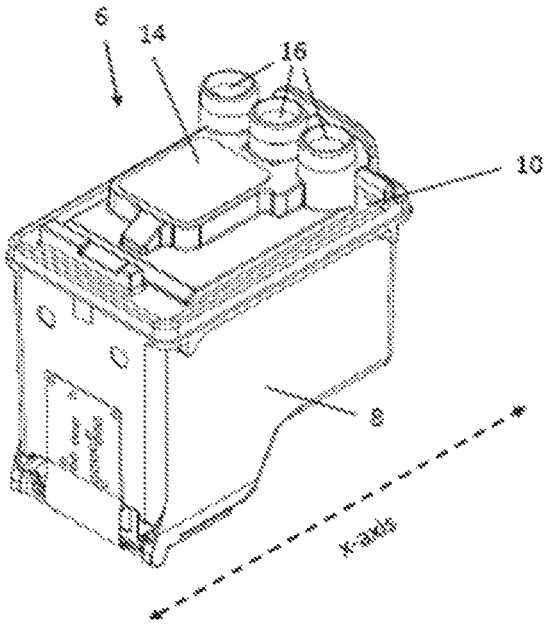
Figure 3:
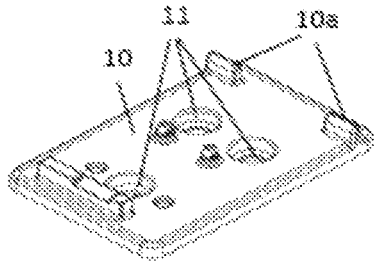
Figure 3:
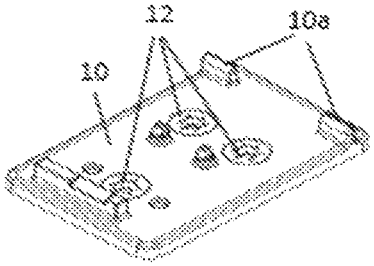
Figure 3:
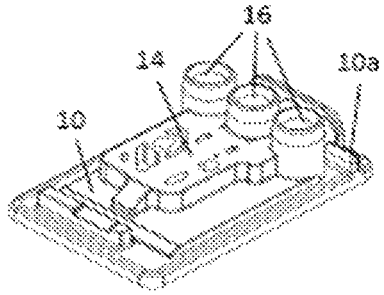
Figure 4:
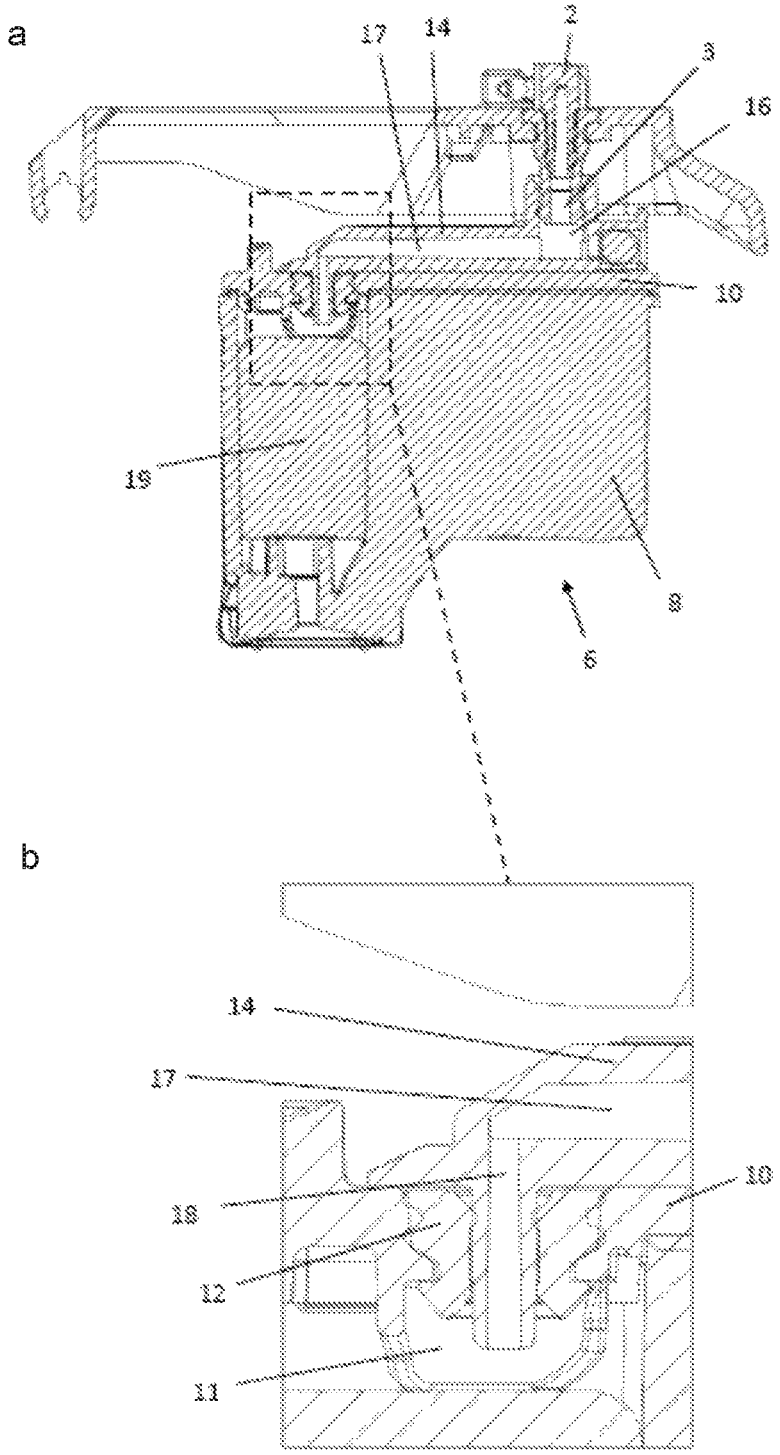
Figure 5:
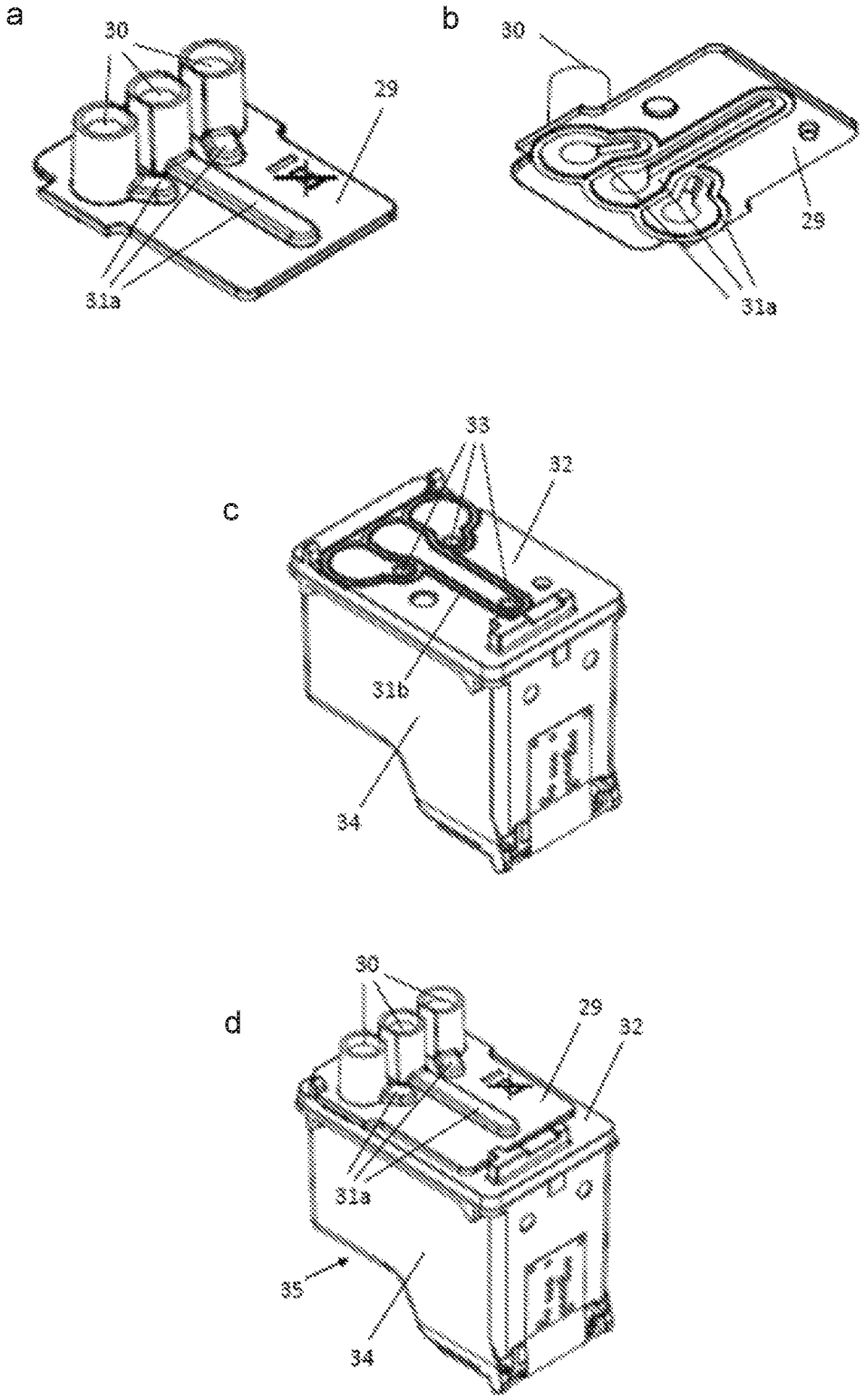
FIGS. 5*a*, 5*b*, 5*c*, and 5*d* are schematics showing another example replaceable container.
Figure 6:
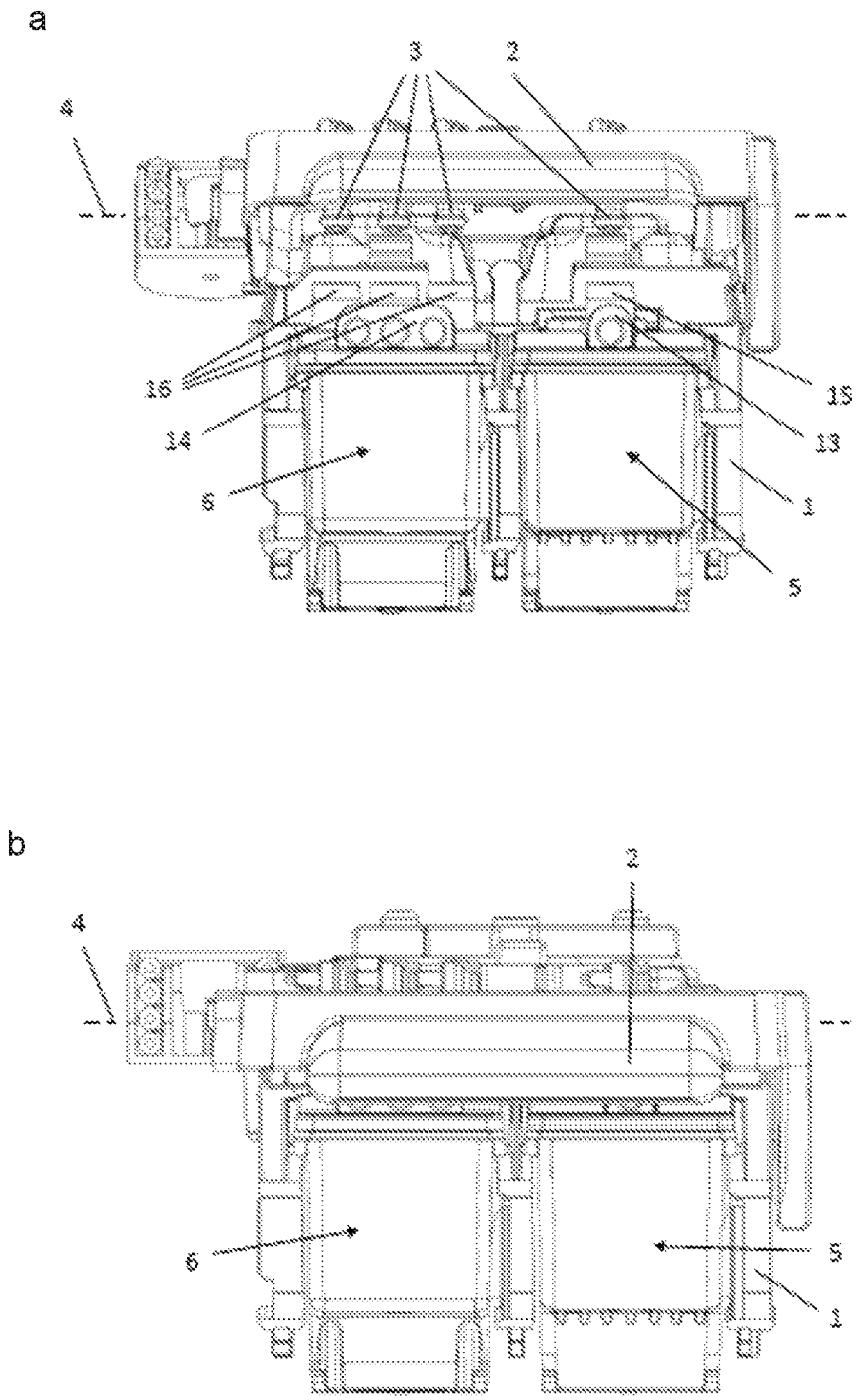
FIGS. 6*a* and 6*b* are schematics showing parts of an example printing system including the example holding fixture and the example carriage manifold of FIGS. 1*a* and 1*b*, as well as the two example replaceable cartridges of FIGS. 2*a* and 2*b*.

Referring to FIGS. 6*a* and 6*b*, parts of an example printing system are illustrated. The example printing system includes both the holding fixture 1 and the carriage manifold 2 already discussed with reference to FIG. 1. The two replaceable cartridges 5, 6 already discussed with reference to FIGS. 2 to 4 are installed in the holding fixture 1. The replaceable cartridge 5 has one lid manifold input port 15 in the shape of a tube socket, wherein the replaceable cartridge 6 has three lid manifold input ports 16 in the shape of tube sockets. The tube sockets 15, 16 of the two replaceable cartridges 5, 6 are positioned on the corresponding lid manifolds 13, 14 in such a way that all tube sockets 15, 16 are aligned along a straight line which is parallel to the pivot axis 4 of the carriage manifold 2.

FIG. 6*a* shows the carriage manifold 2 of the example printing system in the first pivot position. In the first pivot position, the carriage manifold 2 may be fluidly disconnected from the replaceable cartridges 5, 6. This becomes apparent, as the needles 3 of the carriage manifold 2 are not inserted into the tube sockets 15, 16 of the replaceable cartridges 5, 6. Rather, there is a displacement between the needles 3 and the tube sockets 15, 16.

By rotating the carriage manifold along the pivot axis from its first pivot position towards its second pivot position the displacement is reduced to zero once the needles 3 and the tube sockets 15, 16 contact each other. Upon further rotation the needles 3 are inserted into the tube sockets 15, 16, wherein the insertion path runs along a substantially rectilinear path, as already discussed above. When the second pivot position is reached, the needles 3 and the tube sockets 15, 16 are fully engaged and fluid connections between the carriage manifold 3 and the replaceable cartridges 5, 6 are established to supply printing fluid from the cartridge manifold 3 to the replaceable cartridges 5, 6.

FIG. 6*b* shows the carriage manifold 3 of the example printing system in the second pivot position, in which—as described above—fluid connections to the replaceable cartridges 5, 6 are established. In total, four separate fluid connections are established between the carriage manifold 2 and the replaceable cartridge 5, 6. Each of the separate fluid connections runs from a separate needle 3 using a separate tube socket 15, 16, a separate lid channel 17, a separate lid manifold output opening 18 in the shape of a lid manifold output needle, and a separate sealing septum 12 of a lid aperture 11 to a separate area 19 for storing of printing fluid located in one of the replaceable cartridges 5, 6. Three separate areas 19 are located in the body of replaceable cartridge 6. One area 19 is located inside the body of the replaceable cartridge 5.

Figure 7:
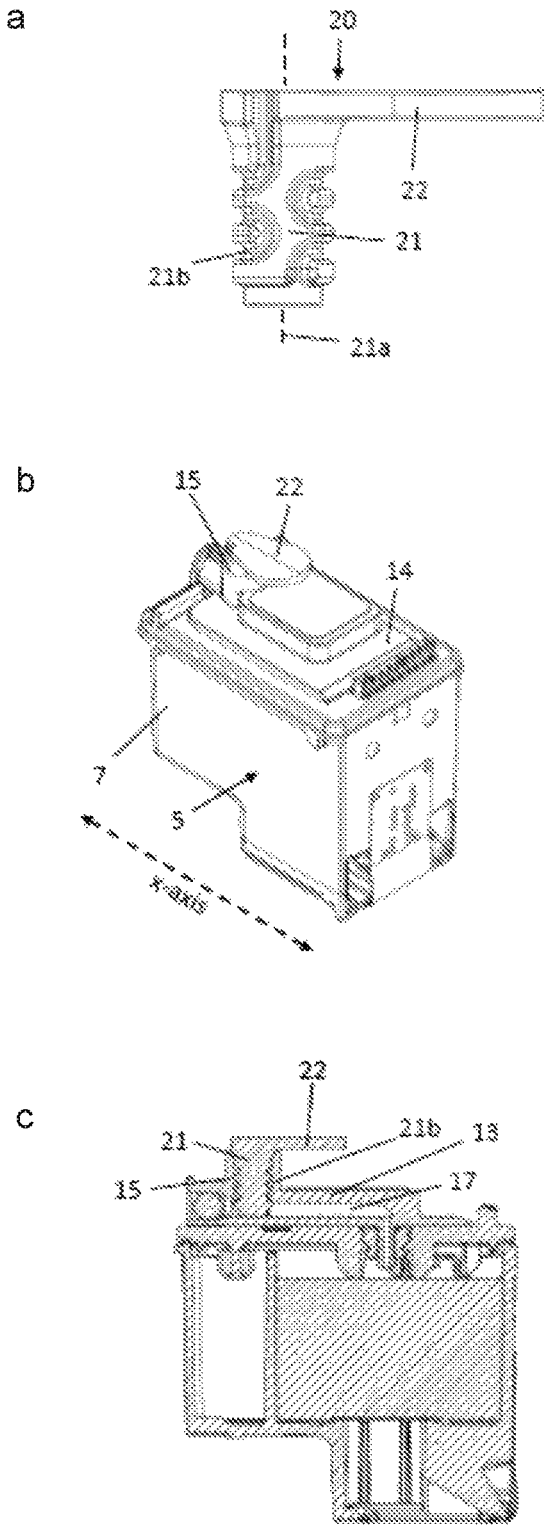
FIGS. 7*a*, 7*b*, 7*c*, and 7*d* are schematics showing example removable plugs.
Figure 7:
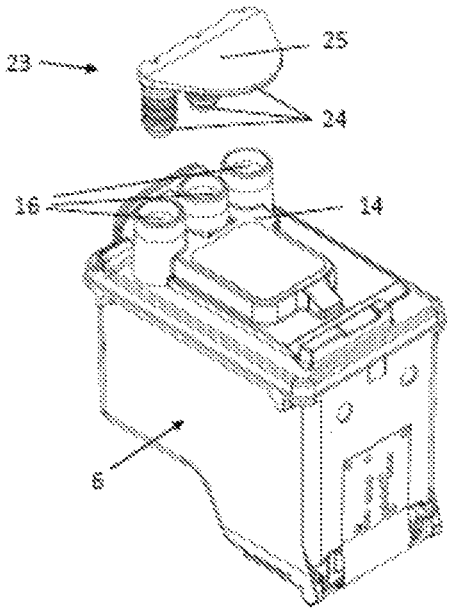

In the following examples, removable covering devices for replaceable cartridges are introduced with respect to FIGS. 7 and 8. It is noted that the removable covering devices are separate objects independent of the replaceable cartridges and printing systems described above.

In an example, the removable covering device for a replaceable cartridge may be for a replaceable cartridge which comprises a lid manifold. The lid manifold may comprise a lid manifold input port. The removable covering device may comprise a cover to cover the lid manifold input port. Further, it may comprise a handling element.

In an example, the removable covering device may be a removable plug for a replaceable cartridge. The replaceable cartridge may comprise a lid manifold. The lid manifold may comprise a lid manifold input port. The lid manifold input port may be in the form of a tube socket. The removable plug may comprise a plug body to be inserted into the tube socket. The plug body may have air channels formed on its outside to allow the replaceable cartridge to vent while the plug body is inserted into the tube socket. Further, the removable plug may comprise a handling element to limit a maximal depth of insertion of the plug body into the tube socket and to allow for a removal of the plug body from the tube socket. The handling element may be connected to the plug body and protrudes from the plug body.

In an example, the removable plug may comprise a number of plug bodies. The number of plug bodies may correspond to a number tube sockets of a replaceable cartridge. Each plug body may be connected to the handling element to allow the number of plug bodies to be inserted into the corresponding number of tube sockets.

In another example, the removable covering device may be a removable tape for a replaceable cartridge. The replaceable cartridge may comprise a cartridge lid. Further, it may comprise a lid manifold mounted to the cartridge lid. The lid manifold may comprise a number of lid manifold input ports in the form of tube sockets. Each tube socket may comprise a notch. The removable tape may comprise a tape body to cover the mouths of the tube sockets which are remote from the cartridge lid with the notches of the tube sockets remaining uncovered to allow the replaceable cartridge to vent air while the tape body is covering the tube sockets. Further, the removable tape may comprise a handling element to remove the tape body from the tube socket. The handling element may be connected to the tape body and may protrude from the tape body.

FIGS. 7*a* to 7*d* illustrate example removable plugs 20, 23 for lid manifold input ports 15, 16 of replaceable cartridges 5, 6, which are in the shape of tube sockets. The removable plugs 20, 23 are to be inserted into the tube sockets 15, 16 by inserting the bodies 21, 24 of the removable plugs 20, 23 into the tube sockets 15, 16 through the mouths of the tube sockets 15, 16. A handling element 22, 25 connected to the removable plugs 20, 23 is not to be inserted into the tube sockets 15, 16. Rather, the handling element 22, 25 may limit a maximal depth of insertion of the plug bodies 21, 24 into the tube sockets 15, 16. When inserted into the tube sockets 15, 16, the removable plugs 20, 23 may protect the tube sockets 15, 16 from any outside contamination, while still allowing the replaceable cartridge 5, 6 to vent through the tube sockets 15, 16.

FIG. 7*a* is a side view of a first example removable plug 20 removed from tube socket 15, 16 showing both the plug body 21 and its handling element 22. The plug body 21 is substantially of cylindrical shape and extends along the body axis 21*a* shown in FIG. 7*a*. In this context, substantially cylindrical shape means that the basic shape of the plug body 21 is cylindrical, while details of the plug body 21, e.g., its air channels 21*b*, may deviate from the cylindrical shape. The basic shape of the plug body 21 is rotationally symmetric with respect to the body axis 2*a*. In other examples, the plug body may have a different shape. In some examples, the outer form of the plug body is complementary to the inner form of the tube socket, in which the plug body of the removable plug is to be inserted.

The plug body 21 has air channels 21*b* formed on its outside. The air channels 21*b* allow the replaceable cartridge 5, 6 to vent, i.e., to allow air from inside the body 7, 8 of the replaceable cartridge 5, 6 to leave the replaceable cartridge 5, 6 using the tube sockets 15, 16, even when the replaceable plug 20 is inserted into the tube socket 15, 16. In some examples, the air channels 21*b* of the removable plug 20 have the form of a labyrinth seal as shown in FIG. 7*a*. In other examples, the air channels are differently formed, allowing air to pass but prevent dust particle and the like to pass while the removable plug 20 is inserted into the tube socket 15, 16.

The handling element 22 is connected to the one end of the plug body 21 that is not to be inserted into the tube socket 15, 16. The handling element 22 has a strap like form with a grip area projecting from the plug body 21 in a direction substantially perpendicular to the body axis 21*a*. In this context, substantially perpendicular means that the grip area of the handling element 222 and the axis 21*a* of the plug body 21 include an angle between 85°-95°. In some examples, the included angle is entirely perpendicular, i.e., 90°. Due to the projecting grip area, the handling element 22 cannot be inserted into the tube socket 15, 16 and thus limits the maximal depth of insertion of the plug body 21 into the tube socket 15, 16.

The removable plug 20 inserted into a tube socket 15, 16 of a replaceable cartridge 5, 6 may be removed from the tube socket 15, 16 by gripping the grip area of the handling element 22 and pulling the latter one away from the replaceable cartridge 5, 6 in a direction which has a component parallel to the body axis 21*a*. By pulling the handling element 22 in the direction, the plug body 21 may be removed from the tube socket 15, 16, and thereby the entire removable plug 20 is removed from the tube socket 15, 16.

FIG. 7*b* shows the replaceable cartridge 5 of FIG. 2*a* with the removable plug 20 inserted into its tube socket 15. FIG. 7*c* displays a cross-sectional view of FIG. 7*b*. The cross-section runs parallel to the x-axis indicated in FIG. 7*b* through the center the tube socket 15. As shown in FIG. 7*c*, a continuous air connection from the channel 17 of the lid manifold 13 to the outside of the removable cartridge 5 exists using the tube socket 15, even with the removable plug 20 inserted into the tube socket 15. The continuous air connection runs along a venting channel formed between the inside wall of the tube socket 15 and the air channels 21*b* formed on the outside of the plug body 21.

FIG. 7*d* illustrates a second example removable plug 23 for insertion into three tube sockets 16 at a time. The removable plug 23 has three plug bodies 24 connected to a single handling element 25. The removable plug 23 is to be inserted into a lid manifold having at least three tube sockets 16, such as the lid manifold 14 of the replaceable cartridge 6 shown in FIG. 7*d* just underneath the removable plug 23.

When the removable plug 23 is inserted into the lid manifold's tube sockets 16, all three plug bodies 24 are simultaneously inserted in the corresponding tube sockets 16. The details of each of the plug bodies 24 are identical to those of the plug body 21 of the removable plug 20 described above with regard to FIGS. 7*a*, 7*b*, and 7*c*.

Further, all details described with respect to the first example removable plug 20 are also present in the second example removable plug 23. The main difference between the two example removable plugs 20, 23 is the number of plug bodies 21, 24 connected to the respective handling element 22, 25. Due to the different number of plug bodies 21, 24, the sizes of removable plugs 20, 23 are different accordingly.

While the two example removable plugs 20, 23 both have gripping areas of the fixed handling elements 22, 25 projecting perpendicularly away from the plug bodies 21, 24, other example removable plugs may have gripping elements in the form of straps, studs, or the like, for gripping and pulling the handling element to remove the inserted removable plugs from the tube sockets.

Figure 8:
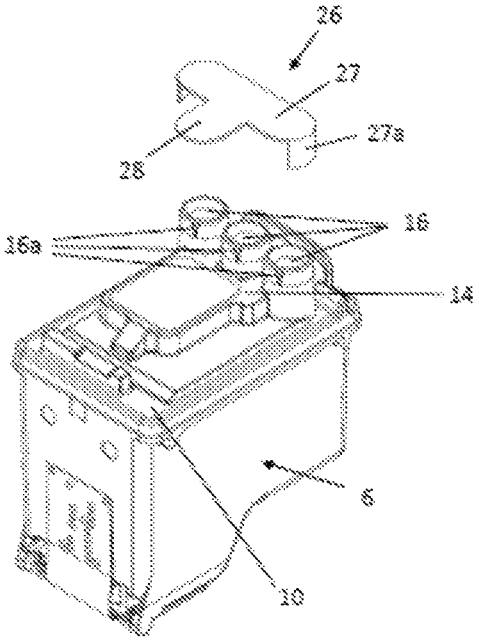
FIG. 8 is a schematic showing an example removable tape to cover the example cartridge of FIG. 2*b*.

Referring to FIG. 8, an example removable tape 26 for a number of lid manifold input ports 16 being in the shape of tube sockets of a replaceable cartridge 6 is shown. The removable tape 26 may be used to cover the mouths of the tube sockets 15, which are located remotely from the cartridge lid 10. The task of the removable tape 26 is identical to that of the removable plugs 20, 23 already described with reference to FIG. 7. The removable tape 26 may protect the tube sockets 16 from outside contaminations while still enabling the replaceable cartridge 6 to vent air. However, the removable tape 26 may be mainly used for simultaneously covering a number of tube sockets 16, while the removable plug 20 may be used to cover just a single tube socket 15.

Removable tape 26 has a tape body 27 and a handling element 28. The tape body 27 contains, and in one example even consists of, a planar tape formed in a way, and/or having a shape, to fit onto the number of tube sockets 16 to be covered by the removable tape. The removable tape 26 of FIG. 8 is to cover three tube sockets 16, which are positioned along a straight line on the lid manifold 14. Thus, the main axis of the tape body 27 extends along the straight line defined by the tube sockets 16. The width of the tape body 27 corresponds to the mouth widths of the tube sockets 16.

In some examples, the tape body 27 has at least one mounting assistance protrusions 27*a*, which extend from the tape body perpendicularly towards the replaceable cartridge 6 when the replaceable tape 26 is about to be mounted, i.e., when it is positioned close to the tube sockets 16 with the tape body 27 facing the mouths of the tube sockets 16. The mounting assistance protrusions 27*a* allow an easy and precise positioning of the tape body 27 on the tube sockets 16 to be covered by aligning the mounting assistance protrusions 27 with the tube sockets 16.

The removable tape 26 is formed such that—when mounted to the replaceable cartridge 6—it does not cover the notches 16*a*, which extend from the mouths of the tube sockets 16 towards the cartridge lid 10. Thus, the replaceable cartridge 6 may be still able to vent air using the notches 16*a*, even when the removable tape 26 covers and protects the tube sockets 16.

The handling element 28 of the removable tape 26 may be used for easy removal of the removable tape 26 from the tube sockets 16. The handling element 28 is connected to the tape body 27 and projects from the tape body 27 in an in-plane direction with respect to the tape body 27. In some examples of removable tapes 26, the handling element 28 is part of the tape body 27. The removable tape 26 covering the tube sockets 16 may be removed from the tube sockets 16 by pulling the handling element 28 of the removable tape 26 in a direction, which has a component away from the replaceable cartridge 6.

While the example removable tape 26 has the above-described fixed handling elements 28 projecting away from the tape body 27 in an in-plane direction, other example removable tapes may have handling elements in the form of straps, studs or the like for gripping and pulling the handling element to remove the installed removable tapes from the tube sockets.

Figure 9:
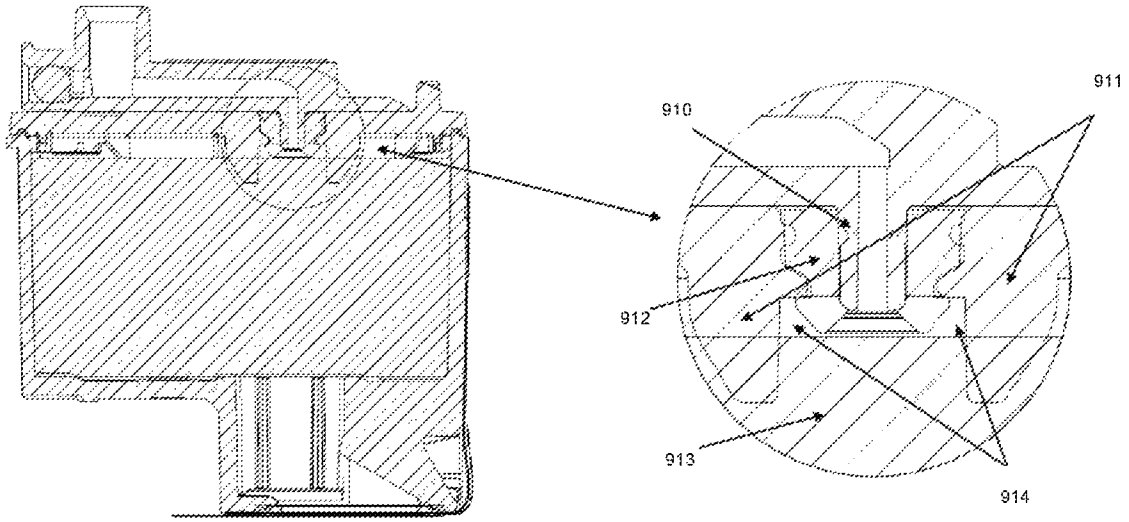
FIG. 9 is a schematic showing the components of an example article as described herein.
Figure 10:
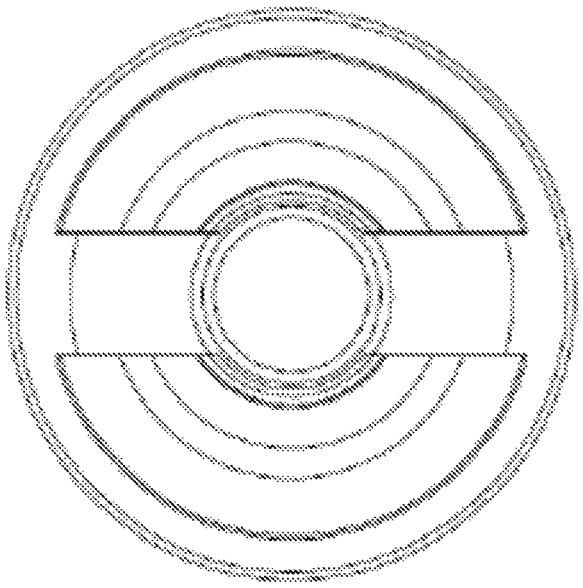
FIGS. 10*a* and 10*b* are schematics showing the top view (10*a*) and side view (10*b*) of an example crenulated septum as described herein.
Figure 10:
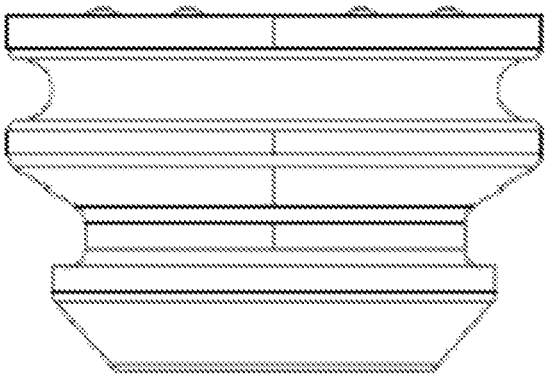

FIG. 9 is a schematic showing the components in one example of the articles as described herein. The needle 910 corresponds to the needle 18 as shown in FIG. 4. As described above, the needle may have any of the length described herein. Septum 912 may be any of those described herein. For example, the septum may be one that has a crenulated exterior, such as that shown in FIGS. 10*a* and 10*b*. The foam 913 foam and foam standoff 911, which may correspond to different portions of area 19 as shown in FIG. 4. The air gap 914 is also shown in FIG. 9 to illustrate one benefit of the articles described herein. For example, in this example, the length of the needles is less than or equal to about 6 mm, such as between about about 3.5 mm and about 4.5 mm, the length permits an air gap of sufficient size between the foam and the manifold needles to permit air to expand back up the tubes during temperature cycling. In one example, the manifold needles are pressed into septa. Also, in one example wherein the septum has crenulations, the septum may aide in the creation of an air path. It is noted that the crenulated septum and the needle of the length described need to be present together and may be present in any combination.

It should be appreciated that all combinations of the foregoing concepts (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

The indefinite articles "a" and "an," as used herein in this disclosure, including the claims, unless clearly indicated to the contrary, should be understood to mean "at least one." Any ranges cited herein are inclusive.

The terms "substantially" and "about" used throughout this disclosure, including the claims, are used to describe and account for small fluctuations, such as due to variations in processing. For example, they may refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

What is claimed:

1. An article, comprising:

a container body;

a lid covering the container body, wherein the lid comprises a lid aperture to permit passage of a printing fluid into the container body; and a lid manifold mounted to the lid, wherein the lid manifold comprises:

a lid manifold input port to be fluidly connected to and disconnected from a container manifold port of a separate printing system, a lid manifold output opening that is in a form of a needle having a length of less than or equal to about 6 mm and is fluidly connected to the lid aperture, and a channel fluidly connecting the lid manifold input port and the lid manifold output opening.

2. The article of claim 1, wherein the length of the needle is between about 3.5 mm and about 4.5 mm.

3. The article of claim 1, wherein the lid aperture comprises a sealing septum having a crenulated exterior.

4. The article of claim 1, wherein the lid aperture comprises a sealing septum having a crenulated exterior and the needle of the lid manifold output opening penetrates the sealing septum.

5. The article of claim 1, wherein the lid manifold input port is in a form of a tube socket to be fluidly connected to and disconnected from needle of the lid manifold output opening.

6. The article of claim 1, which is a part of a multi-printing fluid cartridge comprising a plurality of different printing fluids, wherein the lid manifold comprises for each printing fluid:

a separate lid manifold input port to be fluidly connected to and disconnected from a corresponding separate carriage manifold port;

a separate lid manifold output opening fluidly connected to a corresponding separate lid aperture; and a separate channel fluidly connecting the separate lid manifold input port and the separate lid manifold output opening.

7. The article of claim 1, wherein the separate printing system comprises:

a holding fixture to replaceably install the article, and a carriage manifold comprising a carriage manifold port to supply printing fluid to the container body, wherein the carriage manifold is mounted to the holding fixture to pivot around a pivot axis from a first pivot position to a second pivot position, in the first pivot position the carriage manifold being fluidly disconnected from the installed article, and in the second pivot position the carriage manifold being in fluid connection with the installed article to supply printing fluid to the installed article;

wherein the lid manifold input port of the lid manifold is to be fluidly connected to and disconnected from the carriage manifold port depending on the pivot position of the carriage manifold with the article replaceably installed in the holding fixture.

8. The article of claim 1, wherein the channel of the lid manifold comprises a channel section that extends along an extension direction having a component parallel to an outer surface of the lid.

9. The article of claim 1, wherein the lid manifold comprises a body, and wherein the channel of the lid manifold is an open channel which is sunk-in in a bottom outer surface of the body of the lid manifold.

10. An article, comprising:

a container body;

a lid covering the container body, wherein the lid comprises a lid aperture to permit passage of a printing fluid into the container body, the lid aperture comprising a sealing septum having a crenulated exterior; and a lid manifold mounted to the lid, wherein the lid manifold comprises:

a lid manifold input port to be fluidly connected to and disconnected from a container manifold port of a separate printing system, a lid manifold output opening fluidly connected to the lid aperture, and a channel fluidly connecting the lid manifold input port and the lid manifold output opening.

11. The article of claim 10, wherein the lid manifold output opening is in a form of a needle that has a length of between about 3.8 mm and about 4.0 mm.

12. The article of claim 10, wherein the lid manifold input port is in a form of a tube socket, and wherein the tube socket is positioned along a straight line, which is parallel to a pivot axis of a carriage manifold with the article replaceably installed in a holding fixture.

13. The article of claim 10, wherein the lid manifold comprises a body;

the channel of the lid manifold is an open channel which is sunk-in in a bottom outer surface of the body of the lid manifold; the lid comprises a predefined welding path corresponding to a form of the open channel of the lid manifold, and a liquid and air tight connection between the lid and the lid manifold is established along a welding path by welding.

14. A covering device replaceably covering a container body, comprising:

a handling element;

a cover to cover a lid manifold input port of a lid manifold of the container body, the lid manifold comprising:

the lid manifold input port to be fluidly connected to and disconnected from a container manifold port of a separate printing system, a lid manifold output opening that is in a form of a needle having a length of less than or equal to about 6 mm and is fluidly connected to the lid aperture, and a channel fluidly connecting the lid manifold input port and the lid manifold output opening; and a lid covering the container body, wherein the lid comprises a lid aperture to permit passage of a printing fluid into the container body, the lid aperture comprising a sealing septum having a crenulated exterior.

15. The covering device of claim 14, wherein the length of the needle is between about 3.8 mm and about 4.0 mm.

16. The covering device of claim 14, wherein the covering device is a removable device covering a replaceable container for the printing fluid.

* * * * *